United States Patent [19]

Chikul et al.

[11] 4,180,385

[45] Dec. 25, 1979

[54] FUEL COMPOSITION AND PROCESS FOR PRODUCING SAME

[76] Inventors: Vitaly I. Chikul, ulitsa Panferova, 8, kv. 170; Boris I. Tyagunov, ulitsa Panferova, 8, kv. 22, both of Moscow; Yalmar S. Ulanen, ulitsa Kuuze, 3, kv. 3; Olga S. Chikul, ulitsa Uus, 13, kv. 5, both of Estonskaya SSR, Kiviyli; Karl E. Zeger, Michurinsky prospekt, 54, korpus 3, kv. 148, Moscow; Lev Z. Tamarkin, Ulansky pereulok, 24, kv. 9, Moscow; Robert A. Petrosian, ulitsa Planernaya, 16, korpus 3, kv. 67, Moscow; Vadim E. Chmovzh, ulitsa F. Poletaeva, 19, korpus 1, kv. 194, Moscow; Alexandr S. Smirnov, Leninsky prospekt, 73/8, kv. 149, Moscow; Valentina I. Polyakovskaya, Chernomorsky bulvar, 17, korpus 2, kv. 92, Moscow; Pavel A. Trufanov, ulitsa Piri, 9, kv. 3, Estonskaya SSR, Kiviyli, all of U.S.S.R.

[21] Appl. No.: 746,006

[22] Filed: Nov. 30, 1976

[51] Int. Cl.[2] ..... C10L 1/28

[52] U.S. Cl. ..... 44/62; 44/DIG. 3; 44/68

[58] Field of Search ..... 44/DIG. 3, 62, 68; 208/11 R

[56] References Cited

U.S. PATENT DOCUMENTS

| | | | |
|---|---|---|---|
| 2,949,008 | 8/1960 | Rocchini et al. | 44/62 |
| 3,057,152 | 10/1962 | Rocchini et al. | 44/62 |
| 3,078,664 | 2/1963 | Rocchini et al. | 44/62 |
| 3,332,755 | 7/1967 | Kukin | 44/68 |
| 3,817,722 | 6/1974 | Scott | 44/DIG. 3 |
| 3,925,190 | 12/1975 | Whitcombe et al. | 208/11 R |
| 3,939,057 | 2/1976 | Reed, Jr. | 208/11 R |
| 4,001,105 | 1/1977 | Gifford | 208/11 R |

*Primary Examiner*—Winston A. Douglas
*Assistant Examiner*—Y. Harris-Smith
*Attorney, Agent, or Firm*—Lackenbach, Lilling & Siegel

[57] ABSTRACT

A fuel composition which comprises a high-boiling petroleum fuel and an additive. The additive incorporates compounds of elements Mg, and/or Ca and/or Mn, and/or Al, and/or Fe and also an ash-containing resin.

The additive is prepared by thermal processing of a solid fuel with the formation of a dust-containing vapor-gas mixture. Thereafter, a resin is condensed from the vapor-gas mixture which is incorporated with the above-mentioned compounds of said elements and, finally, the resin is discharged along with the deposited dust.

8 Claims, 1 Drawing Figure

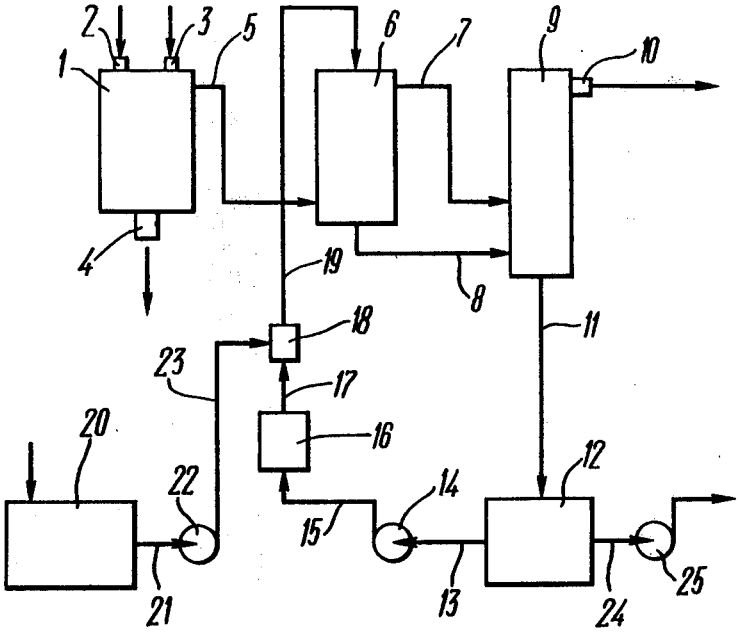
1
2
3
4
5
6
7
8
9
10
11
12
13
14
15
16
17
18
19
20
21
22
23
24
25

FUEL COMPOSITION AND PROCESS FOR PRODUCING SAME

BACKGROUND OF THE INVENTION

The present invention relates to the production of liquid fuels and, more specifically, to reducing, upon combustion of high boiling petroleum fuels and additives, the detrimental effect of sulphur, sodium and vanadium constituents on structural components of equipment utilizing the fuel.

The present invention appears to be most useful in the fuel industry as well as in energetics and other applications including combustion of a fuel, mainly in boiler units, gas turbines, vaporgas plants, heating furnaces and the like.

Combustion of a petroleum fuel containing sulphur, sodium and vanadium compounds results in corrosion, slagging and clogging, with ash deposits on equipment utilizing the fuel.

An effective means adapted for preventing the detrimental effects resides in the use of mineral additives introduced into the flue gases resulting from combustion of a petroleum fuel. Interaction of such an additive with the fuel ash results in an increase of the ash melting point and loss, thereby, of the ability to form dense deposits on equipment utilizing the fuel as well as in deactivation of corrosion-active components of the combustion products and a sharp decrease in the dew point of the flue gases.

Most technologically simple and readily available, especially in heavy-duty devices, is the method of introducing said additives along with the fuel in the form of a composition prepared in advance or during the fuel supply for combustion or during the process of fuel combustion.

Known in the art are fuel compositions containing highboiling petroleum fuels and an additive based on finely dispersed compounds of elements pertaining to the group of Si, Al and Mg (cf. German (Democratic Republic) Pat. No. 52,761 Cl. 24 B 1/01, 23 d of May 16, 1964).

These prior art fuel compositions and processes for producing same feature a disadvantage residing in that the additive incorporates compounds of not all the elements which may be used for the above-mentioned purposes; another disadvantage resides in the necessity of preliminary fine grinding of said solid components of the additive. This is accompanied by high energy costs, utilization of ineffective and expensive equipment, complicated technology of the composition preparation and low reactivity of the additive components. Furthermore, such compositions feature limited stability and can cause erosion of the fuel-supply system members.

Said disadvantages can be partially overcome by a widened range of the elements incorporated into the additive, such as compounds of elements pertaining to the group of Mn, Fe and Ca, as well as due to preliminary suspending thereof in an intermediate liquid as disclosed, for example, in U.S. Pat. No. 3,332,755 of July 25, 1967, Cl. 44-4.

According to said U.S. Patent, the fuel composition contains a high-boiling fuel oil and an additive incorporating compounds of the elements selected from the group of Si and/or Ca and/or Mg, and/or Al, and/or Fe, and/or Mn.

To prepare the additive, compounds of said active elements are mixed with a liquid incorporating surface-active agents, light oils of mainly naphthenic origin, or volatile oil distillates or cresol, or liquid amines as well as glycol ether, a gelatinizing agent or a pigment stabilizer, a hydrophilic colloid and water.

Since compounds of the active elements should be incorporated into the additive in the form of a fine dust, they are subjected to thorough grinding either prior to intermixing with the liquid or during this operation.

Said fuel composition and process for producing same have the following disadvantages.

A great number of relatively expensive raw materials are required for the preparation of said additive.

In the additive preparation active components are finely ground which necessitates using expensive, ineffective, energy consuming equipment.

Stability of the additive and fuel composition is achieved by incorporating therein an expensive, multicomponent intermediate liquid.

At the same time, increasing power demand and limited sources of high-quality fuels stimulate the use of low-grade solid fuels. Since combustion of low-grade fuels is less efficient, said fuels are subjected to preliminary heat-treatment to obtain liquid and gaseous fuels.

In so doing, however, a substantial portion of the liquid fuel thus obtained has a high ash content.

A mixture of resin vapors and gases resulting from the thermal decomposition of the solid fuel (vapor-gas mixture) entrains therewith a fine ash of the thus-processed fuel. At further stages, upon condensation, said ash is deposited with the resin (mainly with its heavier fractions).

Such high-ash content resins do not find wide application.

To reduce the ash content in commercial products, the vapor-gas mixture and condensed resins are subjected to purification. As a consequence, capital investment and production costs of the industrial plants increase substantially. A portion of the resin is lost with the ash removed therefrom and environmental pollution occurs.

SUMMARY OF THE INVENTION

It is an object of the present invention to reduce production costs of a fuel composition incorporating a high-boiling petroleum fuel and an additive lowering the detrimental effect of sulphur, sodium and vanadium contained in the petroleum fuel.

It is another object of the present invention to widen the range of raw materials required for the production of a high-quality liquid fuel.

It is a further object of the present invention to reduce processing costs of a solid fuel.

Still another object of the present invention is to minimize the range and consumption rates of mineral raw materials and to obviate the necessity of fine grinding thereof when preparing the additive.

It is also an important object of the present invention to avoid the necessity of using an expensive multicomponent intermediate liquid.

The final object of the present invention is to reduce pollution of the environment by the waste products resulting from combustion of the fuel composition and thermal processing of solid fuels.

These objects are accomplished with a fuel composition incorporating a high-boiling fuel and an additive containing compounds of the elements such as Si and/or Ca, and/or Mg, and/or aluminum, and/or Mn, the additive, according to the present invention includes an ash-containing resin resulting from thermal processing of a solid fuel.

DETAILED DESCRIPTION OF THE INVENTION

The present invention enables efficient utilization of high-ash content heavy resin resulting from thermal processing of solid fuels. The ash contained in said resin and previously considered as a harmful impurity is used in the fuel composition according to the present invention as an active ingredient of the additive reducing the detrimental effect exerted by sulphur, sodium and vanadium contained in the petroleum fuel, while the heavy resin is incorporated into said composition as a full-value fuel component.

Accordingly, the present invention features the following advantages:

a widened range of raw materials for the production of a high-quality liquid fuel due to incorporating into the fuel composition the resin resulting from heat-treatment of a solid fuel;

reduced costs of processing the solid fuel due to eliminating purification of the heavy resin and discarding the purification wastes;

improved economic characteristics of the production of said fuel composition due to reduced capital and production costs;

reduced environmental pollution due to lowered content of noxious compounds in the fuel composition combustion products and absence of resin purification wastes;

broadened range of action of the additive due to detergent properties of the resin produced from said solid fuel relative to the deposits formed during storage of the petroleum fuel.

In the process for producing a fuel composition, wherein the additive is prepared by thermal processing a solid fuel and formation of a dust-containing vapor-gas mixture, followed by condensation of a resin from the resulting vapor-gas mixture and discharging said resin together with the dust deposited therewith, in accordance with the present invention, the vapor-gas mixture delivered to condensation is incorporated with compounds of elements such as Ca and/or Mg, and/or Al, and/or Fe and/or Mn in the form of salts, oxides, oxychlorides or hydroxides.

In the process according to the present invention, preparation of the additive is combined with the solid fuel processing, whereby preparation of said additive is substantially simplified and made less expensive.

The present invention makes it possible to reduce the range and consumption rates of mineral raw materials in preparing the additive preparation; furthermore, the necessity of fine grinding the raw materials is avoided; the necessity of using expensive multicomponent intermediate liquid is also avoided; energy consumption is substantially reduced.

It is advisable that during the condensation process the vapor-gas mixture be cooled to a temperature of not below 300° C. and the velocity of the mixture be at least 3 m/sec, whereafter this vapor-gas mixture be incorporated with compounds of elements such as Ca and/or Mg, and/or Al, and/or Fe, and/or Mn pre-heated to a temperature within the range of from 110° to 250° C.

Said temperature limits and velocity of said vapor-gas mixture ensure optimum conditions for dispersing the active elements within the additive (i.e. recovery of the active elements in the finely divided form and intermixing thereof with the ash of the vapor-gas mixture).

It is also advisable that said compounds of the elements Ca and/or Mg, and/or Al, and/or Fe, and/or Mn be incorporated into the vapor-gas mixture in such an amount, as calculated for oxides thereof, that their weight ratio to the ash of the deposited dust of the fuel being processed should range from 0.3 to 2.

The content of the active elements in the additive within the above-given limits ensures the highest effect of the additive manifested in prevention of the slag and ash deposit formation, erosion and corrosion of equipment utilizing said fuel composition.

Other objects and advantages of the present invention will now become more fully apparent from the following detailed description of an embodiment of the invention with reference to the accompanying drawing schematically showing an apparatus intended for practical implementation of the process for the preparation of the additive according to the present invention.

The apparatus comprises reactor 1 provided with inlet pipes 2 and 3 for the supply of the solid fuel to be processed and a heat-transfer medium, respectively, and an outlet pipe 4 for the removal of the solid residue resulting from thermal processing of the solid fuel.

Thermal decomposition of the solid fuel is performed in reactor 1. The reactor can be of a bunker- or a silo-type, whereas in the case of using fuels liable to sinter or aggregate and clog, it may be in the form of a rotating drum. The reactor 1 is communicated by means of line 5, to a scrubber 6, wherein condensation of the heavy oil is effected along with deposition of the dust from the dust-containing vapor-gas mixture resulting from thermal decomposition of the solid fuel in reactor 1. Scrubber 6 can be of a spray type. Said scrubber 6 is connected, via lines 7 and 8, to condenser 9. The line 7 is intended for the vapor-gas mixture, while line 8 for the heavy resin with the dust deposited therewith. The condenser 9 is provided with an outlet pipe 10 for the delivery of residual resin vapors, water and gas to further treatment stages.

The lower section of condenser 9 is connected, via line 11, with vessel 12 for the additive. Series-connected line 13, circulation pump 14, line 15, cooler 16, line 17, mixer 18 and line 19 connect the vessel 12 to the scrubber 6.

A tank 20 for the solution of compounds of the elements Ca and/or Mg, and/or Al, and/or Fe, and/or Mn, for example a solution of magnesium chloride, is connected via line 21 to feed pump 22 which is connected via line 23, to the mixer 18.

Vessel 12 is connected, via line 24, to pump 25 which delivers the additive to further process stages.

The apparatus operates in the following manner:

A finely-ground dried fuel such as shale is continuously fed into reactor 1 through inlet pipe 2. Also continuously supplied into reactor 1, through inlet pipe 3, is a solid heat carrier agent, such as ash of the previously processed shale. The ash is heated to a temperature of from 700° to 1,100° C. The resulting mixture of shale and heat carrier agent is kept inside reactor 1 for a period required to heat the shale to a temperature of from 450° to 650° C. and to perform complete thermal decomposition thereof. The mixture of said heat carrier agent and solid residue from said thermal decomposition of the shale is continuously discharged from reactor 1 through outlet pipe 4.

Volatile products of the shale thermal decomposition, i.e., the mixture of resin vapors, water vapors and gas and the dust entrained therewith are delivered from reactor 1 via line 5 to scrubber 6, wherein condensation of heaviest fractions of the resin and deposition of a substantial portion of the dust occurs. To ensure the condensation of resins and facilitate the removal of dust laden resin, the cooled resin of the previously processed shale is continuously supplied into scrubber 6 via line 19.

The vapor-gas mixture is delivered from scrubber 6 to consenser 9 via line 7. The resin circulating and condensed in scrubber 6 along with the deposited dust is fed into said condenser 9 via line 8. Additional condensation of the resin in the amount required to produce the additive is effected in condenser 9 and the dust remaining in the vapor-gas mixture is entrapped. The residual vapor-gas mixture practically free from the dust is delivered to a further application via outlet pipe 10.

The resin mixture fed from scrubber 6 and condensed in condenser 9 is delivered via line 11 to vessel 12. Therefrom said mixture is fed by means of circulation pump 14 into scrubber 6 through series-connected line 15, cooler 16, line 17, mixer 18 and line 19.

Mixer 18 is continuously fed, by means of pump 21, with a solution of magnesium chloride from vessel 20 via line 23.

In said mixture 18 the magnesium chloride solution is mixed with the circulating resin and heated to a temperature of from 110° to 250° C.

Temperature of the resin fed to mixer 18 via line 17 is adjusted by varying operating conditions of cooler 16, thus ensuring the required heating of the solution of magnesium chloride.

In said scrubber 6, water with magnesium chloride dissolved therein is evaporated and magnesium chloride precipitated from the solution as a solid product is suspended within the resin in the form of fine dust.

The dust-containing resin flowing downwards via line 11 into vessel 12 is the final additive ready for use and is fed by means of pump 25, as it is accumulated to the required amount or continuously, for further use.

Given hereinbelow is the description of a specific embodiment of a fuel composition and a process for producing same according to the present invention.

Processed is shale having the following characteristics:

ash-content of the dry mass: 49.0% content of carbonate $CO_2$ in the dry mass: 17.5% combustion heat of the dry mass in a calorimetric bomb: 3,000 kcal/kg

Into reactor 1 shale is continuously supplied, which shale is pre-dried and heated to a temperature of 120° C.; in the reactor said shale is mixed in the ratio of 1:2.2 with a solid heat carrier agent heated to 850° C. The mixture of said shale and heat carrier agent is kept in reactor 1 for 13 minutes to the final temperature of the mixture of 490° C. at which the process of shale semicoking occurs.

The volatile products evolved during the semicoking contain resin vapors in the amount of 170.0 kg per ton of the processed dry shale, gasoline vapors in the amount of 10.5 kg/ton, semicoking gas in the amount of 58.3 kg/ton, water vapors in the amount of 20.0 kg/ton and 1.9 kg/ton of ash containing, per cent: $SiO_2$ 35.0; $Fe_2O_3$ 4.6; $Al_2O_3$ 15.3; CaO 29.2; $SO_3$ 9.6; $K_2O$ 4.0; MgO 1.8; $Na_2O$ 0.5.

By adjusting the cooling conditions in condenser 9, temperature of the vapor-gas mixture at the outlet of said condenser 9 is maintained equal to 200° C.

Crystalline magnesium chloride in the amount of 5.0 kg per ton of the shale being processed is dissolved in water as a 20% solution mixed with the resin being circulated within mixer 18. Adjusting the operation conditions in cooler 16, the mixture temperature is maintained equal to 150° C.

As a result, there are obtained 63.0 kg/ton of the additive with the ash content of 4.3% containing, per cent: $SiO_2$ 22.0; $Fe_2O_3$ 2.9; $Al_2O_3$ 9.6; CaO 18.4; $SO_3$ 6.0; $K_2O$ 2.5; $Na_2O$ 0.3 and MgO 38.3

This additive is admixed to mazut in the amount of 7 kg per ton of the mazut having ash content of 0.10%, which ash contains, per cent: $SiO_2$ 1.85; CaO 2.1; MgO 3.2; $Fe_2O_3$ 1.3; $V_2O_5$ 22.7; $Na_2O$ 15.3 and $SO_3$ 34.8. Ash content of the fuel composition is 0.13%. Mineral portion of the composition contains, per cent: $SiO_2$ 6.5; CaO 6.5; MgO 11.3; $Fe_2O_3$ 1.7; $V_2O_5$ 17.5; $Na_2O$ 11.8; and $SO_3$ 28.2.

Said fuel composition has been tested in a steam generator with an output of 320 t/hr of steam; steam pressure of 140 atm.abs. and overheated steam temperature of 545/545° C. After operation for more than 10,000 hours said pearlite-steel steam generator had no traces of high-temperature corrosion. The initial melting point of the mineral portion of the fuel composition in an oxidizing atmosphere was above 850° C. vs. 620° C. for the mineral portion of the starting mazout.

Deposits on the high-temperature heating surfaces of the steam generator were loose and removed mainly by the stream of flue gases without being accumulated during the steam generator operation.

Corrosion activity of the mineral portion of the above-mentioned composition as determined by austenite steel corrosion at a temperature of 750° C. was 0.12 $g/m^2.hr$.

For evaluation of the effect of active components on the fuel composition quality at different proportions of the components, given hereinbelow are data for the ash melting point which ultimately characterizes the ability of the ash to form slag deposits on the structural members of the equipment utilizing the fuel. The main component of the composition is high sulphur mazut. Ash melting points are determined on a derivatograph designed by E. Paulik, F. Paulik, L. Erdei (Journal of Thermal Anal. 3,63, 1971).

| Component ratio | Additive to mazut ash proportion kgf/kgf | Initial melting point of ash °C. |
|---|---|---|
| No additive | — | 660 |
| $MgO:A_M = 0.6:1$ | 0.5:1 | 750 |
| $MgO:Al_2O_3:A_M = 0.6:0.6:1$ | 0.5:1 | 1,040 |
| $MgO:Fe_2O_3:A_M = 0.6:0.6:1$ | 0.5:1 | 890 |
| $MgO:MnO:A_M = 0.6:0.6:1$ | 0.5:1 | 1,150 |
| $MgO:A_M = 1:1$ | 0.5:1 | 920 |
| $MgO:Al_2O_3:A_M = 1:1:1$ | 0.5:1 | 1,170 |
| $MgO:Fe_2O_3:A_M = 1:1:1$ | 0.5:1 | 1,025 |
| $MgO:Mno:A_M = 1:1:1$ | 0.5:1 | 1,280 |

Note:
$A_M$ is the starting resin ash-content.

What is claimed is:

1. a fuel composition comprising a high-boiling petroleum fuel and an additive consisting essentially of an ash-containing resin containing compounds of elements selected from the group consisting of Si, Ca, Mg, Al, Fe, and Mn, said additive employed in amounts sufficient to reduce the corrosive effect of said fuel upon combustion, and wherein said ash-containing resin is obtained from the thermal processing of a solid fuel.

2. The fuel composition of claim 1 wherein said solid fuel is shale.

3. The fuel composition of claim 1 wherein said additive is present in an amount of about 7 kilograms per ton of fuel.

4. A process for producing a fuel composition additive comprising: thermally decomposing a finely divided solid fuel to produce a solid residue, and volatile products containing a mixture of resin vapor, water vapor, and dust; scrubbing said volatile products to condense and form a dust-containing resin; contacting said dust-containing resin with a compound selected from the group consisting of salts, oxides, oxychlorides, and hydroxides of elements selected from the group consisting of Ca, Mg, Al, Fe, and Mn.

5. The process of claim 4, wherein during condensation of said resin, the volatile products are cooled to a temperature of not less than 300° C., and the velocity of the volatile products is not less than 3 meters per second.

6. The process of claim 5, wherein the condensed resin is contacted with said compounds preheated to a temperature within the range of from 110° to 250° C.

7. The process of claim 6, wherein the ratio of compounds to the deposited dust ash of the fuel ranges from 0.3 to 2% by weight, on an oxide basis.

8. A product formed by the process of claim 4.

* * * * *